US008047821B2

(12) United States Patent
Gu et al.

(10) Patent No.: US 8,047,821 B2
(45) Date of Patent: Nov. 1, 2011

(54) RING RACK OIL PUMPING MACHINE

(75) Inventors: Xinyi Gu, Shandong (CN); Huanbo Zhou, Shandong (CN); Yonghai Liu, Shandong (CN); Zhisheng Tian, Shandong (CN); Zhengyou Feng, Shandong (CN)

(73) Assignee: Sinopec Group, Shengli Petroleum Administration Transport Corporation, Dong Ying District, Dong Ying, Shandong (CN)

( * ) Notice: Subject to any disclaimer, the term of this patent is extended or adjusted under 35 U.S.C. 154(b) by 449 days.

(21) Appl. No.: 12/441,709

(22) PCT Filed: Nov. 13, 2007

(86) PCT No.: PCT/CN2007/003206

§ 371 (c)(1),
(2), (4) Date: Mar. 17, 2009

(87) PCT Pub. No.: WO2008/058463

PCT Pub. Date: May 22, 2008

(65) Prior Publication Data

US 2009/0266186 A1 Oct. 29, 2009

(30) Foreign Application Priority Data

Nov. 17, 2006 (CN) ..... 2006 1 0070317

(51) Int. Cl.
*F04B 39/10* (2006.01)
*E21B 43/00* (2006.01)

(52) U.S. Cl. ..... 417/555.2; 166/68.5; 166/105

(58) Field of Classification Search ..... None
See application file for complete search history.

(56) References Cited

U.S. PATENT DOCUMENTS 5,375,657 A * 12/1994 Shi et al. ..... 166/68.5
7,001,157 B2 * 2/2006 Xiaoxi ..... 417/415

OTHER PUBLICATIONS

Derwent entry for CN 1313451 A.*

* cited by examiner

*Primary Examiner* — Toan Ton
*Assistant Examiner* — Britt Hanley
(74) *Attorney, Agent, or Firm* — Global IP Services; Tianhua Gu

(57) ABSTRACT

The Ring Rack Oil Pumping Machine is comprised of: a base, a frame mounted on the base, a roller mounted at the frame top, a sprocket case connects to the middle of the frame; a input shaft having a lower sprocket and a drive shaft having an upper sprocket are installed at the bottom and top of the sprocket case respectively, the upper sprocket and lower sprocket are connected by a chain; a guide wheel, track gear and centralizer wheel are mounted in sequence on the end of the drive shaft extended out of the sprocket case; the track gear meshes with a rack, a slide rail is mounted with the frame, and a sliding base (21) connected with the slide rail (20) moveably. Comparing to currently using pumping units, this invention features simple structure, high safety and reliability, upgraded efficiency, easy maintenance, smooth running and high durability.

8 Claims, 6 Drawing Sheets

RING RACK OIL PUMPING MACHINE

FIELD OF INVENTION

This invention relates to a new type petroleum exploration machine, that is, the ring rack oil pumping machine.

BACKGROUND OF THE INVENTION

Currently, what used the most often for petroleum exploration are the beam type pumping units, but this kind pumping machine has many disadvantages, such as low power transmission efficiency, low motor power utilization rate, and the stroke cannot be greatly improved.

The Chinese Patent No. 91228837.X publicized the linear pumping machine, which is composed of two special-shape chains, two rail sets (four rails), a commutator, an equalizer and a power system; the E-shape commutator and a middle beam are set up between the two rail sets and side beams are designed at both sides of the two rail sets; the rail sets are connected and fixed via connecting plates and designed with long circular grooves. Although this kind linear pumping unit has higher work efficiency and improved stroke, its structure is too complex, particularly, the four rails and the E-shape commutator are so complex that the required precision is hard to guarantee and manufacture and installation are difficult; moreover, as the rollers of the special-shape chains move in the long circular groove, the chains will get worn and lengthened and vibration or even damages will be caused to spare parts. Therefore, the linear pumping machine is difficult to maintain, not cost-efficient and has low reliability.

SUMMARY OF THE INVENTION

To overcome and avoid the disadvantages of the current technology above said, a Ring Rack Oil Pumping Machine featuring simple structure, stable running, higher efficiency, easy maintenance and high guarantee of safety and reliability is provided.

The Ring Rack Oil Pumping Machine is comprised of: a base, a frame mounted on the base and a roller at the top of the frame; a sprocket case is connected to the middle of the frame, a input shaft having a lower sprocket and a drive shaft having an upper sprocket are installed at the bottom and top of the sprocket case respectively and the upper sprocket and lower sprocket are connected by a chain; a guide wheel, track gear and centralizer wheel are mounted in sequence on the end of the drive shaft extended out of the sprocket case; The track gear meshes with a rack, a slide rail is mounted with the frame, and a sliding base is installed to the rail. The sliding base is connected to a reverse rack having a circular groove, a guide wheel is mounted in the circular groove; the reverse rack has a circular groove inside, in which a rack is mounted. A brake system and a support are installed on the base, a motor is mounted on the support and transfers torque via a transmission to a reducer, the reducer transfers power to the input shaft via a coupling. The input shaft is supported by a bracket mounted on a platform; the brake system is set up between the base and the platform.

Comparing with currently used oil pumping units, this invention features the following merits: simple structure, high safety and reliability, upgraded efficiency, easy maintenance, smooth running and high durability.

DETAILED DESCRIPTION OF THE INVENTION

Figure 1:
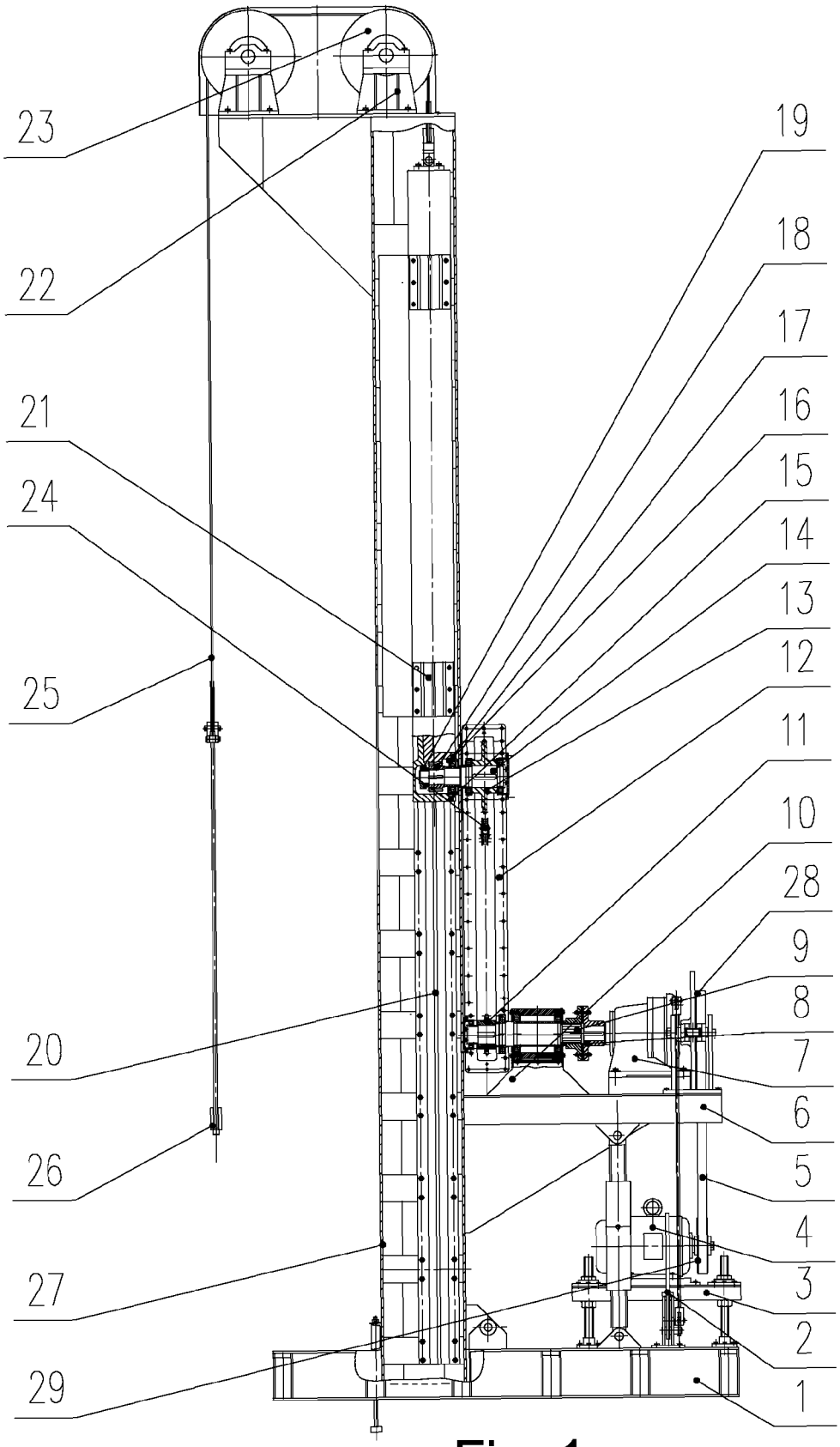
FIG. 1 is a Front view of the invention.
Figure 2:
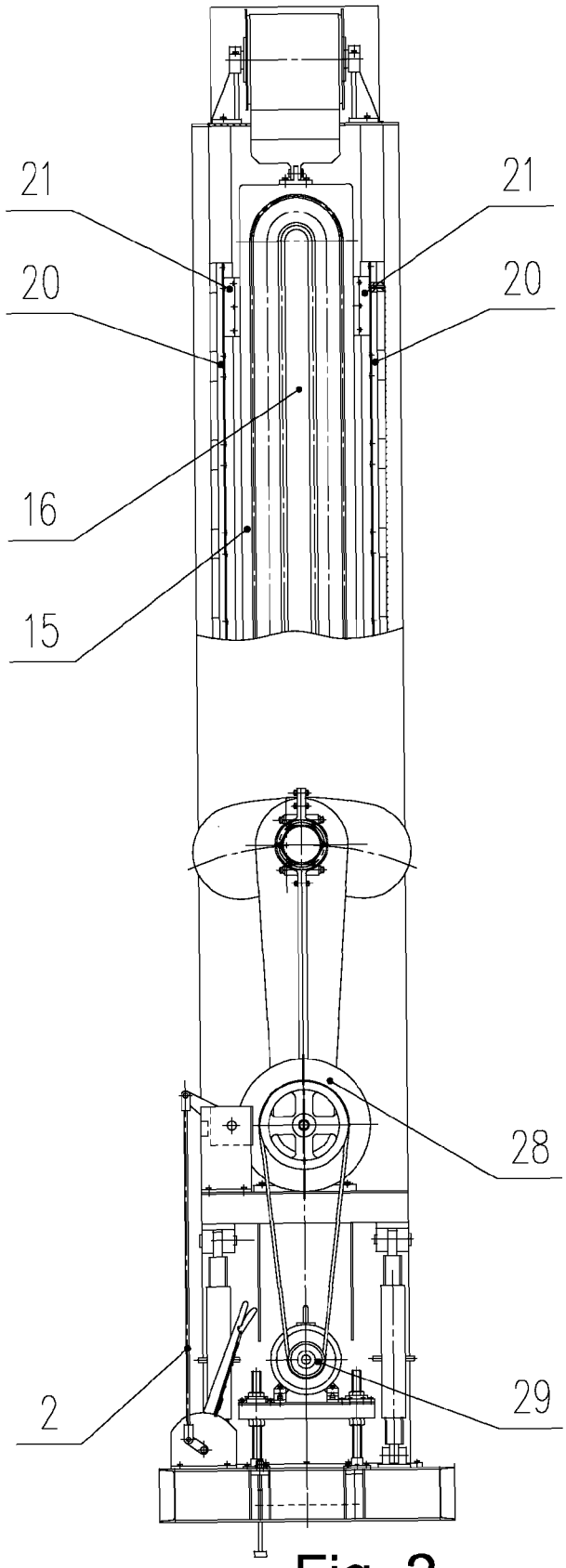
FIG. 2 is a Left view of the invention.
Figure 3:
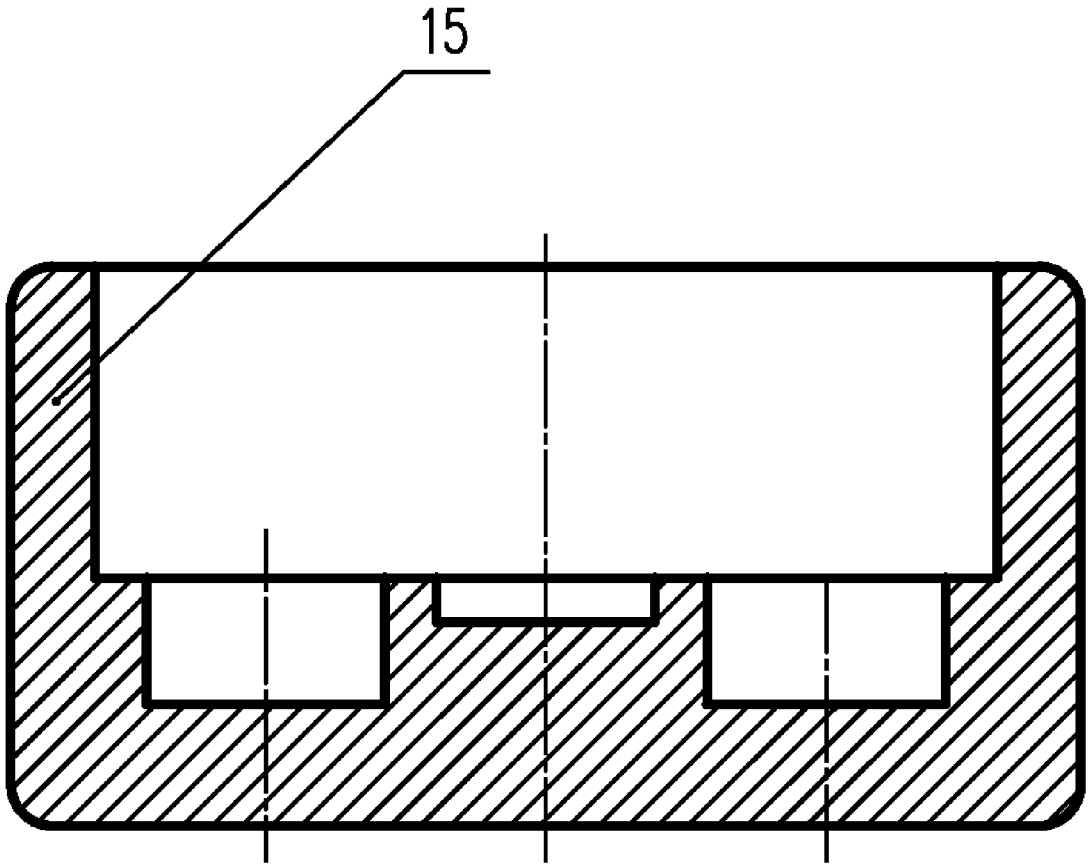
FIG. 3 is a Section view of the Reverse Rack 15.
Figure 4:
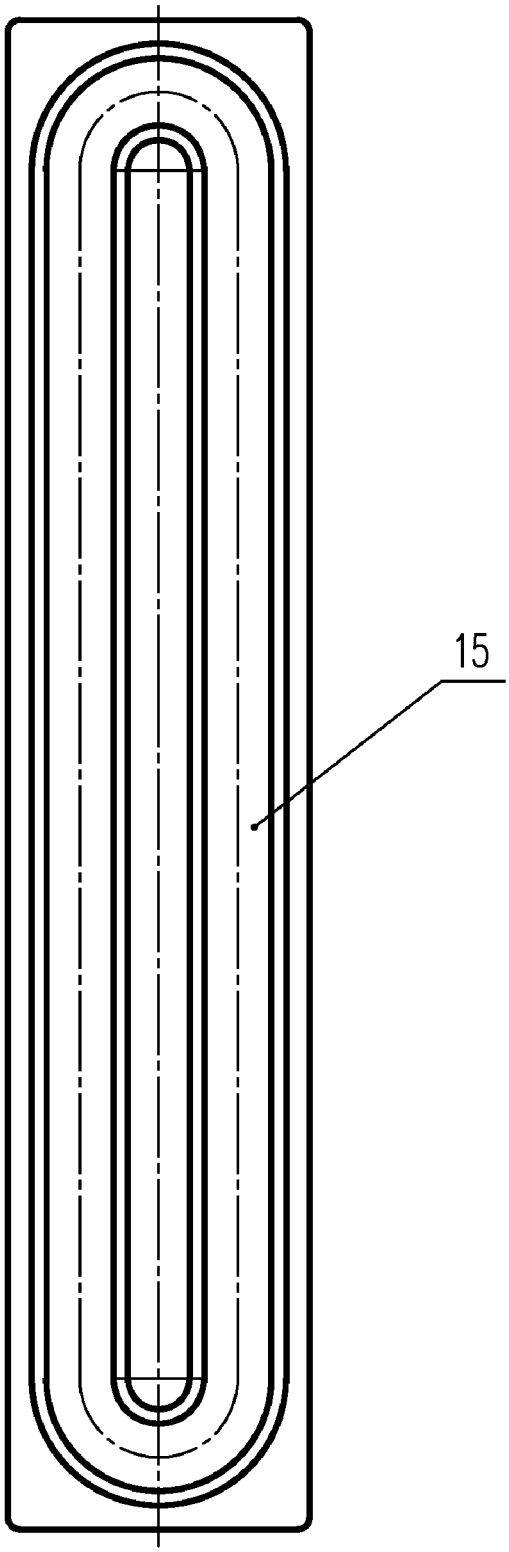
FIG. 4 is a Plan view of the Reverse Rack 15.
Figure 5:
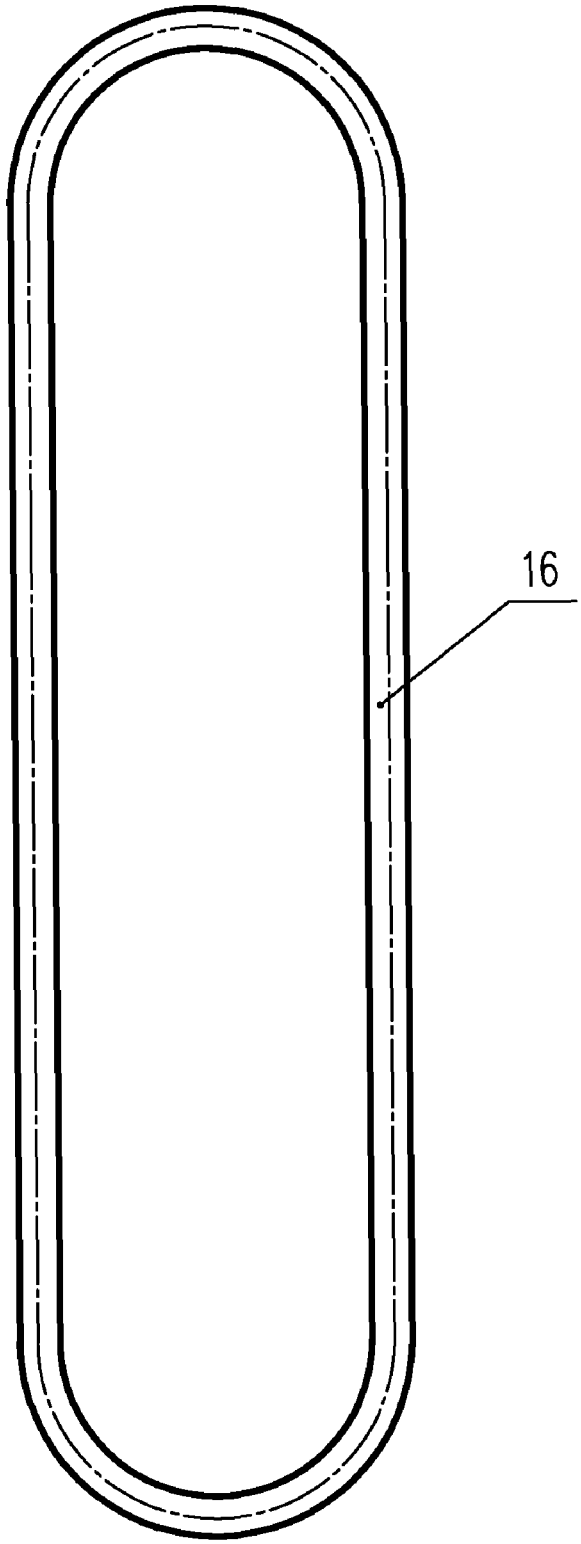
FIG. 5 is a Plan view of the Rack 16.
Figure 6:
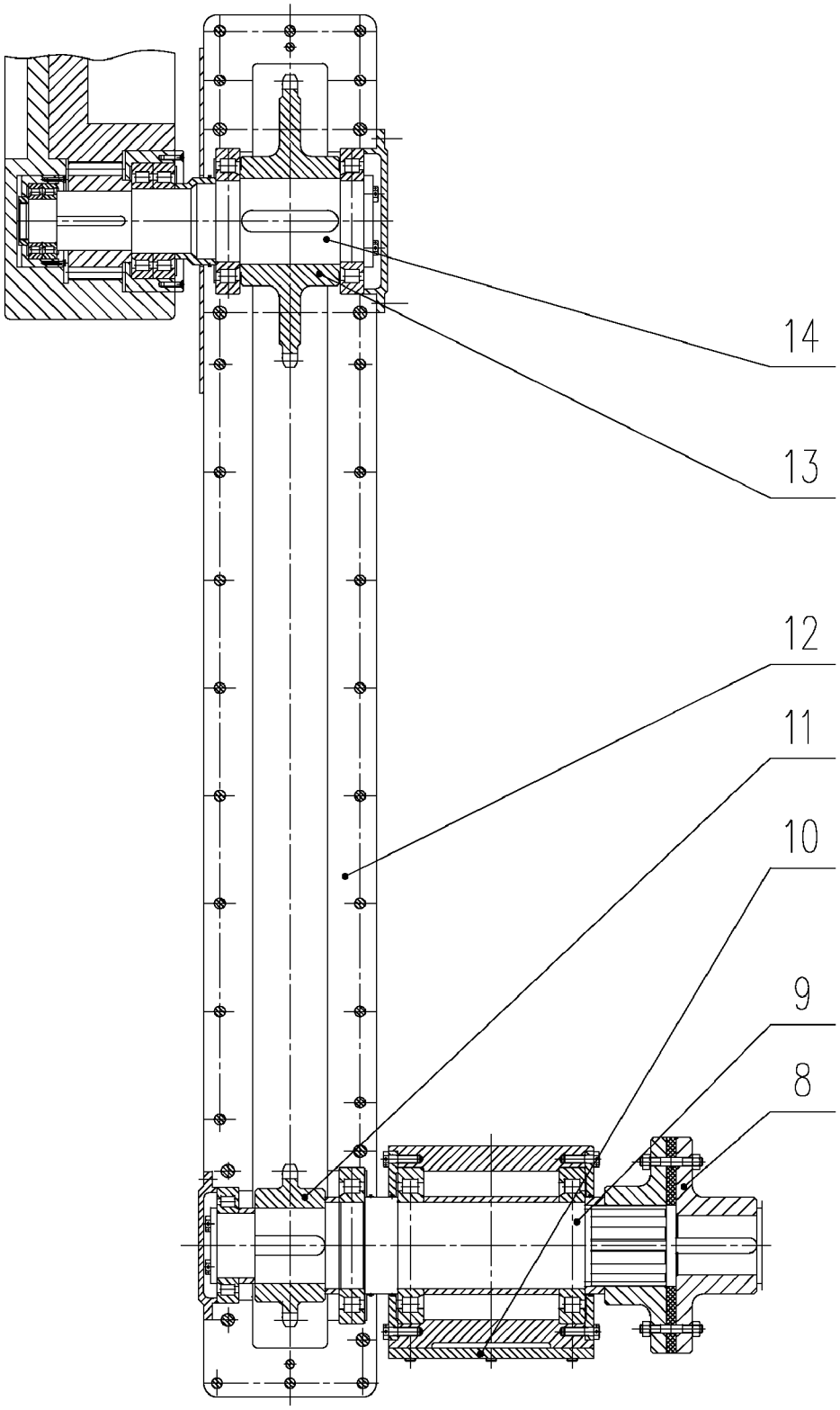
FIG. 6 is a Section view of the Swing Arm.

The Ring Rack Oil Pumping machine is composed of a frame, a transmission and a brake system mounted at the bottom of the frame, a reverse agency inside the frame and a suspension at the top of the frame, composed specifically as in the drawing: a frame 27 mounted on a base 1, a roller 23 mounted at the frame 27 top, a sprocket case 12 is connected to the middle of the frame 27; a input shaft 9 having a lower sprocket 11 and a drive shaft 14 having an upper sprocket 13 are installed at the bottom and top of the sprocket case 12 respectively, the upper sprocket 13 and lower sprocket 11 are connected by a chain 24; a guide wheel 19, track gear 18 and centralizer wheel 17 are mounted in sequence on the end of the drive shaft (14) extended out of the sprocket case (12); the track gear 18 meshes with a rack 16, a slide rail 20 is mounted with the frame 27, and a sliding base 21 is fixed to the slide rail 20. The sliding base 21 is connected to a reverse rack 15 having circular grooves both outside and inside, in which a guide wheel 19 and a rack 16 are mounted respectively. A brake system 2 and a support 3 are installed on a base 1, a motor 4 is mounted on the support 3 and transfers torque via a transmission 5 to a reducer 7, which then transfers power to the input shaft 9 via a coupling 8. The input shaft 9 is supported by a bracket 10 mounted on a platform. The brake system 2 is mounted between the base 1 and the platform 6.

A motor 4 is mounted on a support 3, which is fixed on a frame 27 and a base 1, the frame 27 is connected on the base 1. A reducer 7 is installed on a platform 6 and a coupling 8 is mounted at the reducer output shaft and input shaft 9, the input shaft 9 is supported by a bracket 10 mounted on the platform 6. The sprocket 11 is mounted on the input shaft 9, the lower sprocket 11 and upper sprocket 13 are connected via a chain 24; the upper sprocket 13, centralizer wheel 17, track gear 18 and guide wheel 19 are set up on the drive shaft 14; four sliding bases 21 are equipped up and below the reverse rack 15; when the reverse rack 15 moves up and down, the sliding base 21 moves on the rail 20. The load-bearing belt 25 is connected to the top of the reverse rack 15 and the suspension 26 is connected to the bottom of the load-bearing belt 25, the roller 23 is fixed on the support 22 and mounted at the top of the frame 27.

The up and down movement of the reverse rack 15 of the Ring Rack Oil Pumping Machine can be realized in alternative way: the slide rail 20 can be replaced with 3-4 roller wheels at each side fixed to the frame. One groove is designed at each side of the reverse rack 15 to replace the sliding base 21. When the reverse rack 15 moves up and down, the roller wheels will roll in the grooves and guide the direction.

Running of the machine is realized this way: a motor 4 runs and transfers torque via a pulley 29, a rubber belt 5 and a pulley 28 to a reducer 7; the reducer 7 drives a input shaft 9 and lower sprocket 11 to rotate via a coupling 8; the lower sprocket 11 meshes with a chain 24 and drives an upper sprocket 13, a drive shaft 14 and a track gear 18 to rotate. The track gear 18 meshes with the rack 16 and drives it to move along specific track, the reverse rack 15 is thus driven and moves up and down reciprocate; the reverse rack 15 also drives a load-bearing belt 25 a suspension 26 to move up and down vertically and complete oil pumping.

Direction reverse of the machine is realized via mesh between the rack 16 which is inside the reverse rack 15 and the track gear 18; power of the track gear 18 is provided by the chain and sprockets. The chain, sprockets and the sprocket case comprise the transmission. The up and down movement of the sliding base 21 on the rail 20 can be replaced with the roller wheels (replacing the slide rail) in the grooves (replacing the sliding base) at both sides of the reverse rack.

Publicly known technology regarding this invention is not described in detail.

What is claimed is:

1. A ring rack oil pumping machine comprising:

a base (1), a frame (27) mounted on the base (1) and a roller (23) mounted at the top of the frame (27);

a sprocket case (12) is connected to the middle of the frame (27), a input shaft (9) having a lower sprocket (11) and a drive shaft (14 having an upper sprocket (13) are installed at the bottom and top of the sprocket case (12) respectively, the upper sprocket (13) and lower sprocket (11) are connected by a chain (24); a guide wheel (19), track gear (18) and centralizer wheel (17) are mounted in sequence on the end of the drive shaft (14) extended out of the sprocket case (12); the track gear (18) meshes with a rack (16), a slide rail (20) is mounted with the frame, and a sliding base (21) connected with the slide rail (20) moveably.

2. The ring rack oil pumping machine of claim 1, wherein the sliding base (21) is connected to a reverse rack (15) having a circular groove, and a guide wheel (19) is mounted in the circular groove.

3. The ring rack oil pumping machine of claim 2, wherein is the reverse rack (15) having a circular groove inside, in which a rack is mounted.

4. The ring rack oil pumping machine of claims 1, wherein a brake system (2) and a support (3) are installed on a base (1), a motor (4) is mounted on the support (3) and transfers torque via a transmission (5) to a reducer (7), the reducer (7) transfers power to the input shaft (9) via a coupling (8).

5. The ring rack oil pumping machine of claim 4, wherein the input shaft (9) is supported by a bracket (10) mounted on a platform (6).

6. The ring rack oil pumping machine of claim 5, wherein a brake system (2) is set up between the base (1) and the platform (6).

7. The ring rack oil pumping machine of claims 2, wherein a brake system (2) and a support (3) are installed on a base (1), a motor (4) is mounted on the support (3) and transfers torque via a transmission (5) to a reducer (7), the reducer (7) transfers power to the input shaft (9) via a coupling (8).

8. The ring rack oil pumping machine of claims 3, wherein a brake system (2) and a support (3) are installed on a base (1), a motor (4) is mounted on the support (3) and transfers torque via a transmission (5) to a reducer (7), the reducer (7) transfers power to the input shaft (9) via a coupling (8).

* * * * *